US006320557B1

(12) United States Patent
Chiang

(10) Patent No.: US 6,320,557 B1
(45) Date of Patent: Nov. 20, 2001

(54) HELICAL ANTENNA WITH A BUILT-IN MATCHING CIRCUIT

(75) Inventor: Chi-Min Chiang, Pateh (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/670,534

(22) Filed: Sep. 27, 2000

(51) Int. Cl.[7] ..... H01Q 1/36
(52) U.S. Cl. ..... 343/895; 343/702
(58) Field of Search ..... 343/895, 702, 343/860, 850

(56) References Cited

U.S. PATENT DOCUMENTS 6,137,453 * 2/2001 Wang et al. ..... 343/895
6,188,358 * 2/2001 Clynne ..... 343/895

* cited by examiner

*Primary Examiner*—Tan Ho
(74) *Attorney, Agent, or Firm*—Dougherty & Troxell

(57) ABSTRACT

A helical antenna with a built-in matching circuit therein, wherein, the antenna has a metallic receiving seat of which the surface is connected with an electric circuit board coincident in shape with the receiving seat, a helical microstrip line having an inner starting point and an external terminating point is provided on the electric circuit board; an insulation member is inserted into the metallic receiving seat; a metallic connecting rod is inserted into central holes respectively of the electric circuit board and the insulation member, the metallic connecting rod is welded with the top thereof to the inner starting point of the helical microstrip line and with the bottom end thereof extending downwardly and exposed; a coil element is welded with a bottom end thereof to the external terminating point of the helical microstrip line on the surface of the electric circuit board; thus the helical antenna with the matching circuit is completed without limitation by the matching circuit of a main board.

3 Claims, 4 Drawing Sheets

HELICAL ANTENNA WITH A BUILT-IN MATCHING CIRCUIT

BACKGROUND OF THE INVENTION

1. Field of the Invention

The present invention is related to a helical antenna with a built-in matching circuit therein, and especially to an antenna which is suitable for communication instruments such as a mobile phone. The helical antenna can make frequency matching in the interior thereof.

2. Description of the Prior Art

Helical structures used as signal receiving and emitting antennae have been well known for a long period. Such helical antennae have been changed a lot in structure and impedance matching in the recent years for they shall simultaneously suit multiple frequencies such as 900 KHZ and 1800 KHZ. For example, in a British patent No. 2,206,243, a lengthy coil and a linear conductor extending into the coil are used to form a dual-frequency helical antenna. And in a Japanese patent No. 1997-320748, a coil provided in an external sleeve can determine its resonance frequency by an extending-in length of an adjusting member extending into the coil from outside of the sleeve.

While the coil element of a helical antenna in the present days can even have sections of different looseness, i.e., a coil can simultaneously suit multiple frequencies. However, no matter how the coil structure and its design are changed, such as for a mobile phone, a problem of matching between the circuit of the antenna and the coil element on a main board is involved. Fundamentally, the circuit of an antenna includes the factors of using capacitors, inductors and grounding etc., different structures of helical antenna surely concern the requisition of using matching elements with different capacity and inductance. However, a main board and an antenna are made by different manufacturers, such requisition of coordination in manufacturing thus is a bothersome matter.

SUMMARY OF THE INVENTION

The object of the present invention is to provide a helical antenna with a built-in matching circuit, the coil element of the helical antenna can be matched by its own circuit provided to allow itself to be used commonly on a main board of the same structure. And when it is necessary, the main board can have its matching circuit for the antenna omitted to leave a space for designing circuits with other functions.

To get the above stated object, the present invention provides on the surface of a receiving seat of the coil element a matched electric circuit board, the circuit board has on the surface thereof a helical microstrip line, an inner starting point in the helical microstrip line is connected with the upper end of the exposed metallic connecting rod extending downwardly, an external terminating point of the helical microstrip line is connected with the bottom end of the coil element, and the receiving seat is grounded, thereby the helical antenna with a matching circuit can be completed.

The present invention will be apparent in its novelty and other characteristics after reading the detailed description of the preferred embodiment thereof in reference to the accompanying drawings. Wherein:

DETAILED DESCRIPTION OF THE PREFERRED EMBODIMENT

Figure 1:
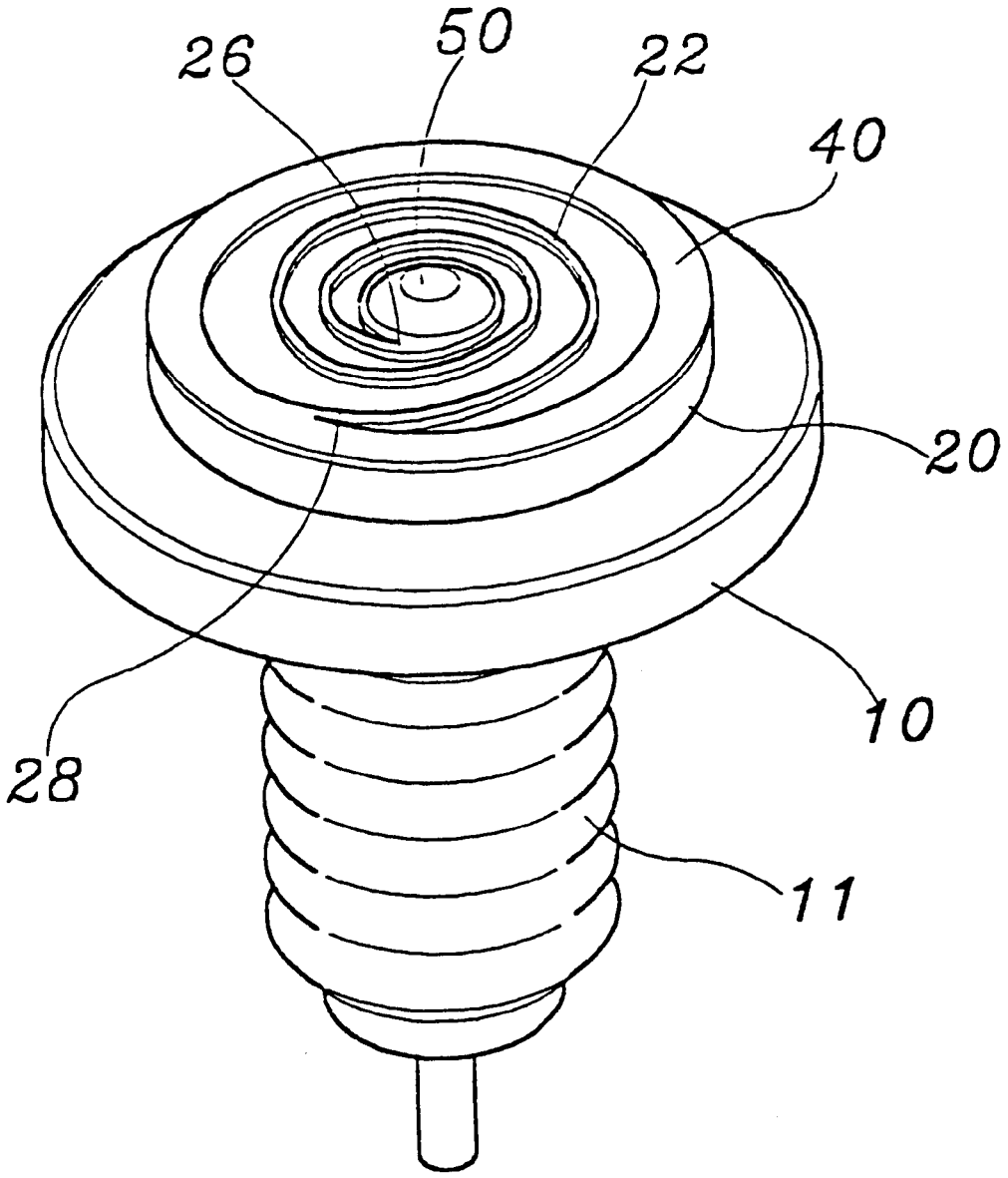
FIG. 1 is a perspective view of a preferred embodiment of the present invention.
Figure 2:
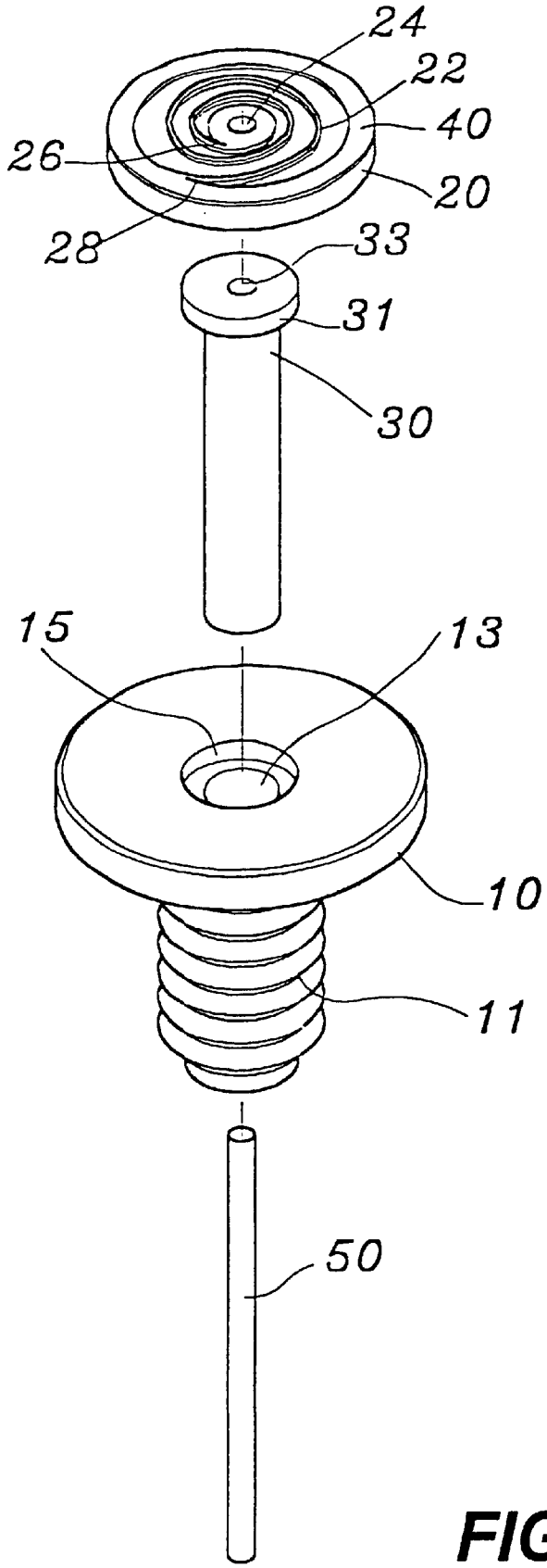
FIG. 2 is an analytic perspective view showing the elements of FIG. 1.
Figure 4:
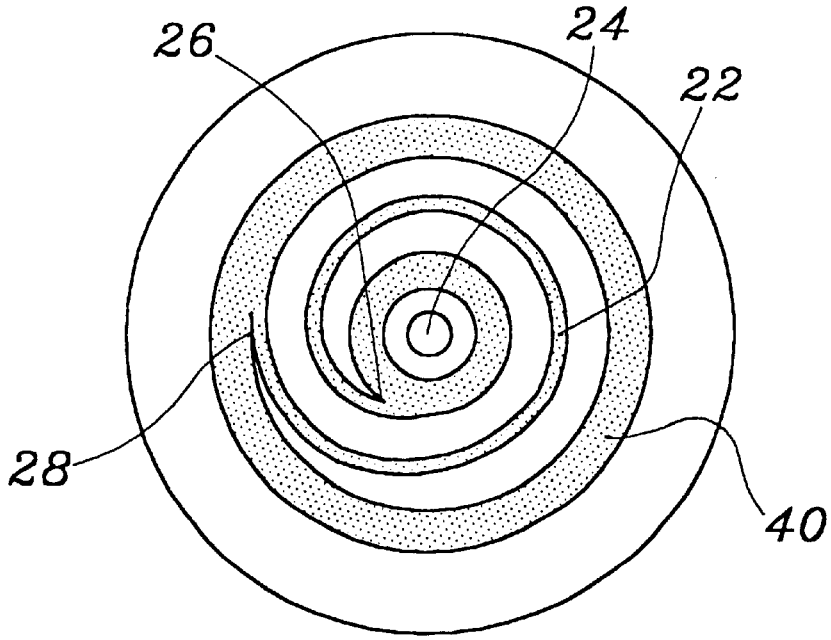
FIG. 4 is a top view of FIG. 1.
Figure 3:
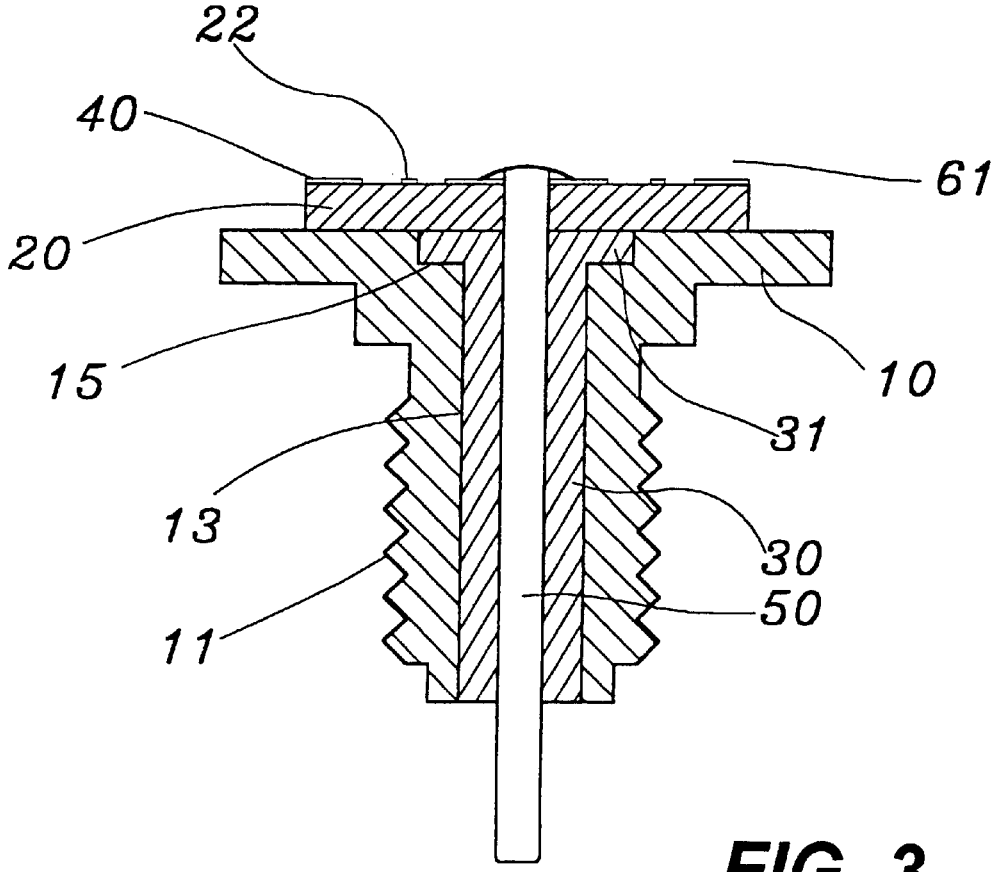
FIG. 3 is a sectional view of FIG. 1.

Referring to FIG. 1, the present invention has a metallic receiving seat 10 of which the surface is connected with an electric circuit board 20 coincident in shape with the receiving seat 10. The receiving seat 10 is made of metal, and is provided with a threaded connecting portion 11 for connecting with a communication instrument (such as a mobile phone). In the embodiment depicted, as shown in FIG. 2, the metallic receiving seat 10 is provided with a central hole 13 and an enlarged countersunk 15 concentric with the central hole 13.

The central hole 13 and the enlarged countersunk 15 of the metallic receiving seat 10 can be inserted therein an insulation member 30 to form an insulation structure. The insulation member 30 includes a shank and a top lid 31 with a smaller central hole 33. The whole insulation member 30 had better be made of Teflon.

The electric circuit board 20 can be assembled on the surface of the metallic receiving seat 10 to have its backside clung to the latter, while the top surface thereof can be provided with a ¼λ (wavelength) helical microstrip line 22. The microstrip line 22 can be provided on the top surface of the electric circuit board 20 by any of various processing method.

In the preferred embodiment shown, the top surface of the electric circuit board 20 is provided with a copper foil layer 40; a processing such as etching is performed to form the desired helical microstrip line 22 on the copper foil layer 40. The helical microstrip line 22 can thus have an inner starting point 26 near an inner central hole 24 of the electric circuit board 20 and an external terminating point 28 connected with a remaining external ring of the copper foil layer 40.

The metallic receiving seat 10 and the electric circuit board 20 having been positioned and combined together have the inner central hole 24 of the electric circuit board 20 aligned and communicated with the smaller central hole 33 of the insulation member 30, thereby, a metallic connecting rod 50 can be inserted into the holes 24, 33 with the top thereof combined with the inner starting point 26 of the helical microstrip line 22 while the bottom end thereof exposed from the metallic receiving seat 10.

Figure 5:
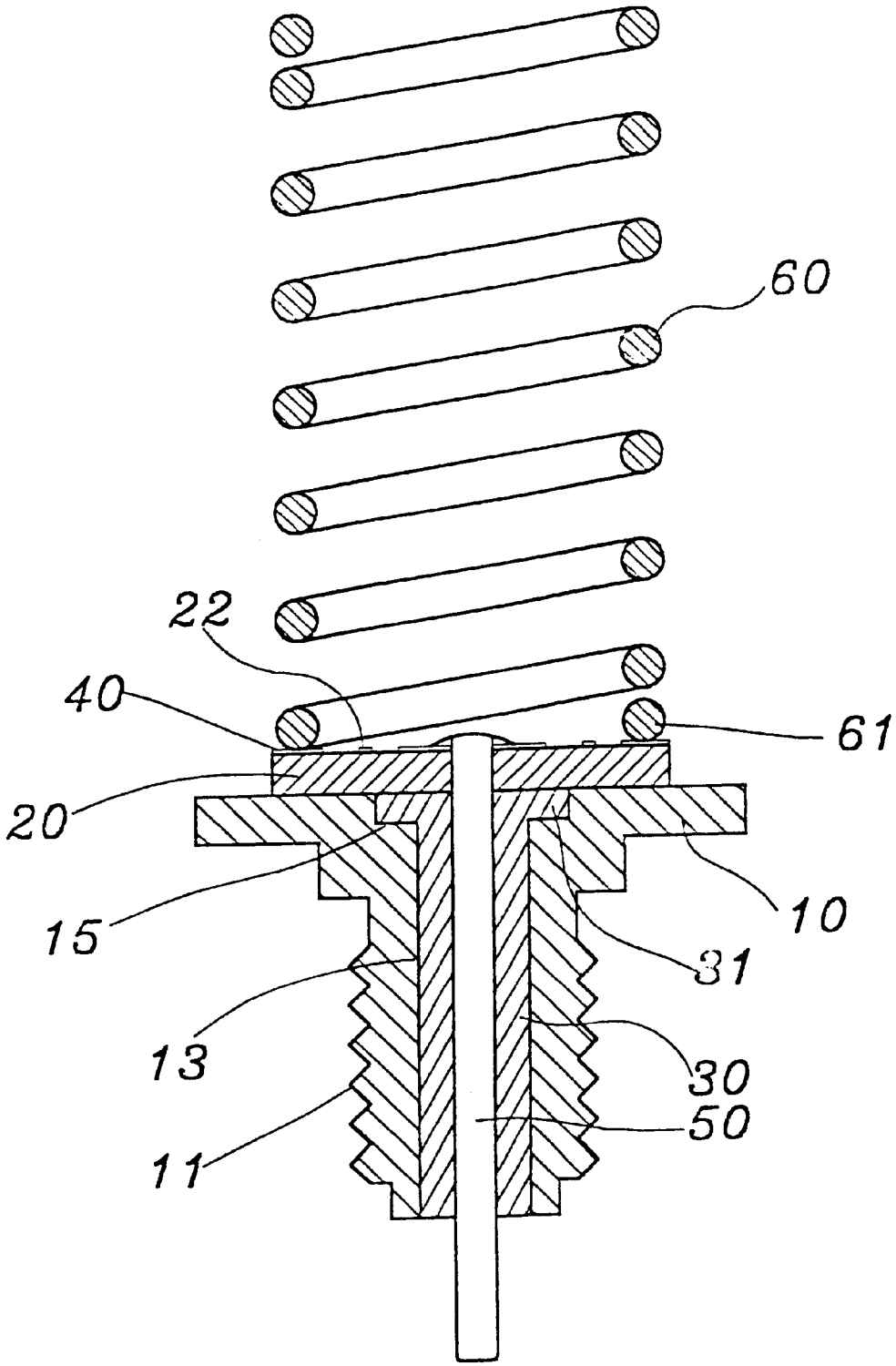
FIG. 5 is a schematic view showing assembling of the present invention as shown in FIG. 1.

After the above stated assembling process, as shown in FIG. 5, a coil element 60 is placed on the surface of the electric circuit board 20 with the bottom end 61 thereof being welded to the external terminating point 28 of the helical microstrip line 22.

In the preferred embodiment shown, the bottom end 61 of the coil element 60 is welded to the remaining external ring of the copper foil layer 40.

The metallic receiving seat 10 in the above stated structure is grounded, the bottom end of the exposed metallic connecting rod 50 thereof makes electric current flow through the helical microstrip line 22 to match with the coil element 60 when it is electrically connected with a communication instrument for receiving and emitting signals with desired frequencies.

By the fact that a built-in matching circuit is used in the antenna, the matching circuit for the antenna on the internal main board of the communication instrument such as a mobile phone originally can thus be transferred onto the antenna proper without limitation by the matching circuit of the internal main board; and this is the principal advantage of the present invention. Another advantage of the present invention is earning a space for providing other functional circuits by omission of the matching circuit in the internal main board.

The preferred embodiment disclosed above is only for illustrating the present invention. It will be apparent to those skilled in this art that various modifications or changes can be made to the elements of the present invention without departing from the spirit of this invention. Accordingly, all such modifications and changes also fall within the scope of the appended claims and are intended to form part of this invention.

What is claimed is:

1. A helical antenna with a built-in matching circuit therein, wherein, said antenna has a metallic receiving seat of which the surface is connected with an electric circuit board coincident in shape with said receiving seat, a helical microstrip line having an inner starting point and an external terminating point is provided on said electric circuit board; an insulation member is inserted into said metallic receiving seat; a metallic connecting rod is inserted into central holes respectively of said electric circuit board and said insulation member, said metallic connecting rod is welded with the top thereof to said inner starting point of said helical microstrip line and with the bottom end thereof extending downwardly and exposed; a coil element is welded with a bottom end thereof to said external terminating point of said helical microstrip line on the surface of said electric circuit board; thus said helical antenna with said matching circuit is completed.

2. A helical antenna with a built-in matching circuit therein as defined in claim 1, wherein, said helical microstrip line is a ¼ λ helical microstrip line.

3. A helical antenna with a built-in matching circuit therein as defined in claim 1, wherein, the top surface of said electric circuit board is provided with a copper foil layer for forming said helical microstrip line, said inner starting point is formed near an inner central hole of said electric circuit board and an external terminating point is formed in connecting with a remaining external ring of said copper foil layer.

* * * * *